United States Patent [19]

Baker

[11] Patent Number: 4,657,513

[45] Date of Patent: Apr. 14, 1987

[54] TRANSOM BRACKET WATER DEFLECTOR FOR IMPROVED BOAT PERFORMANCE

[75] Inventor: Ronald C. Baker, Antioch, Ill.

[73] Assignee: Outboard Marine Corporation, Waukegan, Ill.

[21] Appl. No.: 710,609

[22] Filed: Mar. 11, 1985

[51] Int. Cl.[4] ..... B63H 1/18

[52] U.S. Cl. ..... 440/66

[58] Field of Search ..... 440/52, 66, 65, 71, 440/113, 900; 248/640-643; 114/152, 285, 279, 284, 271

[56] References Cited

U.S. PATENT DOCUMENTS

| | | | |
|---|---|---|---|
| 885,370 | 4/1908 | Palmer | 440/71 |
| 1,553,160 | 9/1925 | Hickman | 114/271 |
| 1,827,806 | 10/1931 | Aitken | 440/66 |
| 2,713,843 | 7/1955 | Staley | 440/65 |
| 3,075,490 | 1/1963 | Lang | 114/279 |
| 3,768,432 | 10/1973 | Spaulding | 440/66 |
| 4,449,945 | 5/1984 | Ferguson | 440/53 |

*Primary Examiner*—Joseph F. Peters, Jr.
*Assistant Examiner*—Jesûs D. Sotelo
*Attorney, Agent, or Firm*—Michael, Best & Friedrich

[57] ABSTRACT

A transom bracket adapted to be mounted on a boat transom and adapted to extend rearwardly of the boat transom to support a propulsion unit rearwardly of the boat transom. The transom bracket includes a water deflection device for preventing water from impinging against portions of the propulsion unit lower unit when the lower unit moves through the water. The water deflection device includes first and second deflection surfaces, sloping downwardly and converging, the first and second deflection surfaces including spaced apart upper surface portions, and lower surface portions which converge and define a line extending between the transom and the lower unit.

17 Claims, 4 Drawing Figures

TRANSOM BRACKET WATER DEFLECTOR FOR IMPROVED BOAT PERFORMANCE

FIELD OF THE INVENTION

The present invention is directed to means for mounting outboard motors on the transom of a boat, and more particularly to transom brackets for use in mounting outboards on boats having hulls of the type normally adapted to house an inboard engine or a stern drive propulsion means.

BACKGROUND PRIOR ART

Outboard motors conventionally include a propulsion unit having a power head including an internal combustion engine. The propulsion unit also includes a lower unit having a rotatably mounted propeller drivingly connected to the engine. Extended transom brackets are used to permit outboard motors to be mounted on the transoms of boat hulls of the type specifically designed for a stern drive or inboard engine. Extended transom brackets commonly support the propulsion unit in a position which is spaced a substantial distance rearwardly of the trailing edge of the bottom of the boat hull. The positioning of the propulsion unit in spaced relation rearwardly of the transom generates problems in performance and boat handling. Another common problem with extended transom brackets is that there is excessive water spray at the transom and around the lower unit. Additionally, the operator may experience torque in the steering system causing difficult steering. Another feature which is experienced as a result of mounting a propulsion unit on an extended transom bracket is that the boat may tend to porpoise.

It has been found that use of an extended transom bracket for supporting the propulsion unit rearwardly of the trailing edge of the bottom of the boat causes the water surface where it meets the gearcase to fluctuate in height. When the bow of the boat is raised either from the acceleration of the boat or as a result of movement of the boat through rough water, the lower unit or gearcase of the propulsion unit is driven deeper into the water. As more of the lower unit enters the water, there is an increase in the water resistance on the propulsion unit, and this increased resistance can cause porpoising of the boat. This increased resistance can also cause water spray from the lower unit forwardly toward the transom, and increased torque on the lower unit. This torque on the lower unit can cause steering difficulties.

On a conventional outboard motor, the portions of the lower unit or gearcase below the lower mount and above the anti-ventilation plate sometimes have forward portions including relatively broad surface areas. As the boat moves through the water, if acceleration or rough water causes these portions of the lower unit to enter the water, the relatively broad surface areas of the forward portions of the lower unit generate increased water resistance and each of the characteristics referred to above may occur.

Attention is directed to the U.S. Pat. No. 3,075,490 showing a bracket for attachment to a boat transom and for mounting a propulsion unit. The transom bracket of Lang is intended to permit the propulsion unit and the propeller to move downwardly into the water when the speed is increased in order to increase the operating efficiency of the propusion unit. The transom bracket of Lang also includes a deflection plate mounted below and rearwardly of the bottom of the boat hull. The deflection plate of Lang is wedge-shaped when viewed in plan and is intended to split the water such that it passes on either side of the motor strut.

Attention is also directed to the U.S. Pat. No. 4,449,945 issued May 22, 1984, and illustrating a transom bracket having a lower brace member rearwardly of a bottom portion of the transom and supporting opposite sides of the transom bracket.

Attention is further directed to the U.S. Pat. No. 1,827,806, issued Oct. 20, 1931; the U.S. Pat. No. 885,370, issued Apr. 21, 1908; the U.S. Pat. No. 3,768,432, issued Oct. 30, 1973; and the U.S. Pat. No. 2,713,843 issued July 26, 1955.

SUMMARY OF THE INVENTION

The present invention provides a transom bracket adapted to be mounted on a boat transom and adapted to support a propulsion unit rearwardly of the boat transom. The propulsion unit includes a lower unit extending downwardly and having a lower end supporting a propeller. The transom bracket includes a lower portion defining water deflection means for preventing water from impinging against a portion of the lower unit when the lower unit moves through the water. The water deflection means includes a first deflection surface and a second deflection surface, the first and second deflection surfaces sloping downwardly and converging, the upper surface portions of the first and second deflection surfaces being spaced apart, and the lower surface portions of the first and second deflection surfaces converging and defining a line extending between the transom and the lower unit of the boat.

The invention also includes the combination of a boat having a hull and a transom, a propulsion unit having a lower unit supporting a propeller, and means for supporting the propulsion unit rearwardly of the transom. The means for supporting the outboard motor comprises a transom bracket having a forward portion adapted to be fixed to the boat transom, and a rearward portion adapted to support the propulsion unit, and the transom bracket including means for deflecting water away from a portion of the lower unit. The means for deflecting includes a first deflection surface and a second deflection surface, the deflection surfaces sloping downwardly and converging, and the first and second deflection surfaces including upper surface portions which are spaced apart and lower surface portions which converge and define a line extending between the transom and the lower unit.

In one embodiment of the invention, the lower unit includes a generally horizontal water deflection plate above the propeller, and the first and second deflection surfaces converge at a line below the water deflection plate and above the propeller.

In one embodiment of the invention, at least a portion of the first and second deflection surfaces are submerged when the propulsion unit is operating.

In one embodiment of the invention, the forward portions of the lower edges of the first and second deflection surfaces are positioned adjacent the rearward edge of the boat hull bottom, and the rearward portions of the lower edges of the first and second deflection surfaces are adjacent the anti-ventilation plate of the lower unit.

In one embodiment of the invention, the first and second deflection surfaces define a "V" and are formed by a pair of plates joined at their lower edges, the plates including spaced apart upper edges fixed to an upper portion of the transom bracket.

One of the principal advantages of the present invention is that the deflection means of the present invention prevents water from impinging against the relatively wide portion of the propulsion unit gearcase above the anti-ventilation plate and below the engine mounts and causes water to flow around the gearcase in a uniform manner rather than striking the gearcase.

Another feature of the deflection means is that it generates hydraulic lift at the transom during acceleration and causes the boat hull to plane more quickly. The deflection means also deflects water from impinging against the lower unit, thereby reducing drag and facilitating quicker planing and improved performance.

The deflection means embodying the invention also reduces the possibility of water ingestion into the powerhead by preventing water from climbing the exhaust housing during planing.

An additional advantage achieved by the deflection means is that the propeller is allowed to work in water that is less aerated because the trailing edge of the deflection means functions as an extension of the hull bottom and extends the bottom closer to the propeller. The water at the propeller is less aerated thereby decreasing propeller slip and increasing propeller thrust.

The provision of the deflection means also causes hydraulic lift rearwardly of the transom and this hydraulic lift reduces the possibility of porpoising. The surfaces of the deflection means also function as rudders when the boat is at idle speed, and this reduces boat wandering.

Various features of the invention will be apparent from reference to the following description of a preferred embodiment, from the drawings and from the claims.

Figure 1:
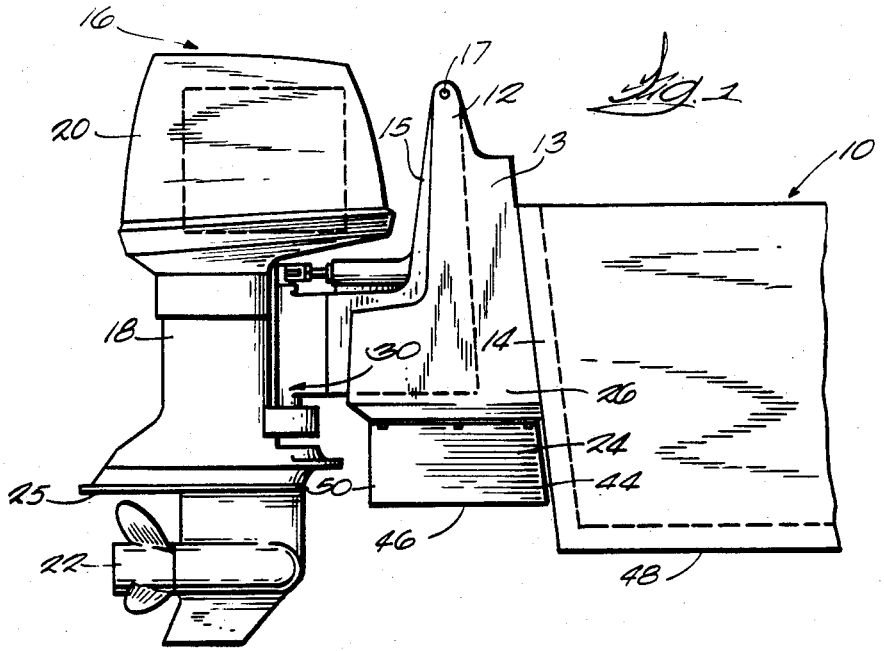
FIG. 1 is a side elevation view of a transom bracket embodying the invention supporting a propulsion unit on the stern of a boat.

Before describing at least one embodiment of the invention in detail, it is to be understood that the invention is not limited in its application to the details of construction and to the specific steps set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a boat 10 supporting a propulsion unit mounting assembly 12 and including a hull of the type having a full transom 14 and being of the type commonly supporting a stern drive or inboard power source. The propulsion unit mounting assembly 12 extends rearwardly from the stern of the boat and provides a means for supporting a conventional propulsion unit 16 rearwardly of the stern or transom 14 of the boat and in spaced relation from the boat transom. The propulsion unit 16 includes a lower unit 18 extending downwardly from a power head 20, and a propeller 22 is mounted on the lower end of the lower unit 18. As is conventional, the lower unit 18 also includes an anti-ventilation or water deflection plate 25 above the propeller.

The propulsion unit mounting assembly 12 includes a transom bracket including a mounting portion 13 adapted to be secured by conventional means to the rear of the boat transom. The mounting portion 13 includes an upper portion having means for pivotally mounting a swivel bracket assembly 15 for swinging movement of the swivel bracket assembly about a generally horizontal pin 17. The transom bracket 12 further includes a lower portion 26 and a deflector 24 extending downwardly from the lower portion 26 and defining deflection surfaces 28 extending rearwardly from adjacent a lower portion of the boat transom 14 toward the lower unit 18. The deflector 24 functions to provide a planing area and prevents water from impinging against a forward portion 30 of the lower unit 18 above the anti-ventilation plate 24 as the boat hull is propelled through the water by the propulsion unit 16. The deflector 24 extends downwardly from the lower portion 26 of the transom bracket and at least a lower portion of the deflector 24 extends downwardly into the water.

Figure 3:
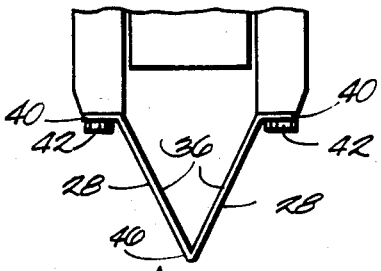
FIG. 3 is an end elevation view of the transom bracket shown in FIG. 2.
Figure 4:
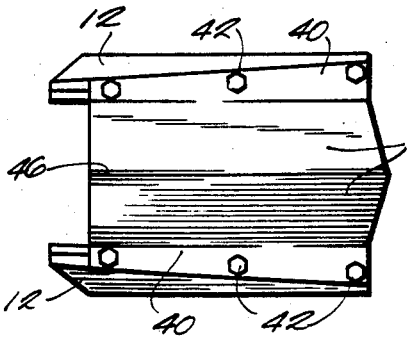
FIG. 4 is a bottom plan view of the transom bracket shown in FIG. 2.

The deflector 24 comprises a generally V-shaped structure including a pair of generally planar water deflection surfaces 28. As best shown in FIG. 3, in one embodiment of the invention, the deflector 24 is comprised of a pair of plates 36 which extend downwardly from the lower portion of the transom bracket and converge so as to intersect at their lower ends. While in other embodiments of the invention, the deflector 24 could comprise an integral portion of the transom bracket, in the illustrated arrangement, the deflector 24 is secured to the lower portion 26 of the transom bracket and extends downwardly therefrom. The upper edges of the plates 38 are spaced apart, and while various means could be provided for securing the upper edges of the deflector plates to the lower portion 26 of the transom bracket, in the illustrated arrangement, flanges 40 extend outwardly from the upper edges of the plates 36. Bolts 42 extend upwardly through the flanges 40 and secure the flanges 40 to a lower surface portion of the transom bracket.

Figure 2:
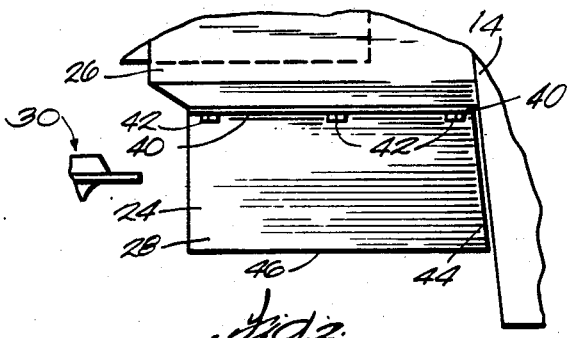
FIG. 2 is an enlarged view of a portion of the transom bracket illustrated in FIG. 1.

As illustrated in FIGS. 1 and 2, the deflector is positioned with a forward portion 44 of the deflector 24 immediately rearwardly of the boat hull, and the lower edge or converging portion 46 of the deflector 24 is positioned above the bottom 48 of the boat hull. The rearward portion 50 of the deflector is adjacent a forward portion 30 of the lower unit, and the lower edge 46 of the deflector 24 is at about the same height as the anti-ventilation plate 25 of the lower unit 18.

While in other embodiments of the invention, the deflector 24 could comprise a solid structure, in the illustrated arrangement, it is open at its forward and rearward ends, and defines a generally V-shaped cavity.

In operation of the boat, as the boat moves forwardly through the water, water is displaced by the boat hull and then moves upwardly past the rearward edge of the hull bottom 48 so as to impinge against upwardly and outwardly sloping surfaces 28 of the deflector 24. The deflector 24 will cause the water to flow around the forward portion 30 of the lower unit 18 above the anti-ventilation plate 25 and prevent the water from impinging against this portion of the lower unit. This results in a reduction of drag in the water and also prevents water from splashing forwardly from the upper portion of the lower unit 18.

The deflecting surfaces 28 of the deflector 24 also define a planing area generating lift. During operation of the boat 10, and as the boat 10 accelerates, this planing area provides lift at the rear of the boat and facilitates quicker planing of the boat. The lift generated by the deflector 24 also has the effect of reducing the tendency of the boat to porpoise in the water. The deflector 24 also functions as a rudder and improves the steering characteristics of the boat and reduces the tendency of the boat to wander at idle speed.

Another feature of the deflector 24 is that it reduces the possiblity of water ingestion into the powerhead by preventing water from climbing the exhaust housing during planing of the boat.

An additional feature of the deflector 24 is that the propeller 22 is allowed to function in water that is less aerated because the deflector 24 effectively extends the trailing edge of the bottom of the boat hull toward the propeller. Since the propeller is working in less aerated water, there is less propeller slip and improved boat speed.

Various features of the invention are set forth in the following claims.

I claim:

1. A transom bracket adapted to be mounted on a boat transom and adapted to support a propulsion unit which is located rearwardly of the boat transom and which includes a lower unit extending downwardly and having a lower end supporting a propeller about a rotary axis, and a generally horizontal water deflection plate above the propeller, said transom bracket comprising a portion adapted to be fixed to a boat transom and a lower portion defining water deflection means for preventing water from impinging against a portion of the lower unit when the lower unit moves through the water, said water deflection means including a first deflection surface and a second deflection surface, each of said first and second deflection surfaces including a lower surface portion and an upper surface portion, said upper surface portions being spaced apart, and said lower surface portions converging downwardly and defining a line extending from adjacent the transom and toward the lower unit and having a rearward end located adjacent the lower unit in the area between the water deflection plate and the propeller axis.

2. A transom bracket as set forth in claim 1 wherein said first and second deflection surfaces are partially submerged when the propulsion unit is operating.

3. A transom bracket as set forth in claim 1 wherein said upper portions of said first and second deflection surfaces are spaced apart at a distance greater than the width of the lower unit.

4. A transom bracket as set forth in claim 1 wherein said water deflection means includes forward portions positioned adjacent the rearward edge of the boat hull bottom and wherein said first and second deflection surfaces include rearward portions adjacent the lower unit.

5. A transom bracket as set forth in claim 1 wherein said first and second deflection surfaces define a V and are formed by a pair of plates, said plates including spaced upper edges and integrally joined lower edges.

6. A transom bracket as set forth in claim 1 wherein said water deflection means includes a first planar plate defining said first deflection surface and a second planar plate defining said second deflection surface, said planar plates defining a V-shaped housing, said housing being open at its forward and rearward ends.

7. A combination comprising a boat including a hull having a transom, a propulsion unit including a lower unit having an upper portion and a lower portion, said lower portion supporting a propeller about a rotary axis, and a generally horizontal water deflection plate above said propeller, and means for supporting said propulsion unit rearwardly of said transom, said means for supporting including a transom bracket having a forward portion fixed to said boat transom and including means for deflecting water away from said upper portion of said lower unit, said means for deflecting including a first deflection surface and a second deflection surface, each of said first and second deflection surfaces including a lower surface portion and an upper surface portion, said upper surface portions being spaced apart, and said lower surface portions converging downwardly and defining a line extending from adjacent said boat transom toward said lower unit and having a rearward end located adjacent said lower unit and in the area between said water deflection plate and said propeller axis.

8. A combination as set forth in claim 7 wherein said first and second deflection surfaces are partially submerged when said propulsion unit is operating.

9. A combination as set forth in claim 7 wherein said upper portions of said first and second deflection surfaces are spaced apart at a distance greater than the width of said lower unit.

10. A combination as set forth in claim 7 wherein said water deflection means includes forward portions positioned adjacent said transom and wherein said first and second deflection surfaces include rearward portions adjacent said lower unit.

11. A combination as set forth in claim 7 wherein said first and second deflection surfaces define a V and are formed by a pair of plates including spaced upper edges and integrally joined lower edges.

12. A water deflector adapted to be secured to a transom bracket which includes a portion adapted to be mounted on a boat transom, which also includes a lower portion, and which extends rearwardly of the boat transom and is adapted to support a propulsion unit which is located rearwardly of the boat transom and which includes a lower unit extending downwardly and having a lower end supporting a propeller about a rotary axis, and a generally horizontal water deflection plate above the propeller, said water deflector comprising a first deflection surface and a second deflection surface, each of said first and second deflection surfaces including a lower surface portion and an upper surface portion, said upper surface portions being spaced apart and being adapted to be secured to the lower portion of the transom bracket such that the water deflector is positioned between a lower portion of the boat transom and the lower unit of the propulsion unit, and said lower surface portions converging downwardly and defining a line extending between the transom and the lower unit of the propulsion unit and having a rearward end located adjacent the lower unit and in the area between the water deflection plate and the propeller axis.

13. A water deflector as set forth in claim 12 wherein said first and second deflection surfaces are partially submerged when the propulsion unit is operating.

14. A water deflector as set forth in claim 12 wherein said upper portions of said first and second deflection surfaces are spaced apart at a distance greater than the width of the lower unit.

15. A water deflector as set forth in claim 12 wherein said water deflector includes forward portions positioned adjacent the rearward edge of the boat hull bottom and wherein the lower edges of said first and second deflection surfaces have rearward portions adjacent the lower unit.

16. A water deflector as set forth in claim 12 wherein said first and second deflection surfaces define a V and are formed by a pair of plates joined at their lower edges, said plates including spaced upper edges fixed to the transom bracket.

17. A water deflector as set forth in claim 12 wherein said first deflection surface is defined by a first planar plate and said second deflection surface is defined by a second planar plate, said planar plates defining a V-shaped housing open at its forward and rearward ends.

* * * * *